US008176854B2

(12) United States Patent
Smith, Jr. et al.

(10) Patent No.: US 8,176,854 B2
(45) Date of Patent: May 15, 2012

(54) ROOF STRUCTURE FOR A LOCOMOTIVE POWER MODULE

(75) Inventors: Geary Walter Smith, Jr., Peoria, IL (US); Timothy Scott McChesney, Chillicothe, IL (US); Edwin Ray Winter, Dahinda, IL (US); Jay Dee Schmechel, East Peoria, IL (US)

(73) Assignee: Progress Rail Services Corp, Albertville, AL (US)

( * ) Notice: Subject to any disclaimer, the term of this patent is extended or adjusted under 35 U.S.C. 154(b) by 529 days.

(21) Appl. No.: 12/232,600

(22) Filed: Sep. 19, 2008

(65) Prior Publication Data

US 2010/0071584 A1 Mar. 25, 2010

(51) Int. Cl.
*B61C 17/04* (2006.01)

(52) U.S. Cl. ..... 105/26.05; 52/45

(58) Field of Classification Search ..... 105/26.05, 105/35, 62.1, 133, 140, 377.01, 396, 401, 105/409, 423; 52/45–56; 296/208
See application file for complete search history.

(56) References Cited

U.S. PATENT DOCUMENTS

| | | | | |
|---|---|---|---|---|
| 1,780,001 | A | 10/1930 | Bruce | |
| 2,090,420 | A * | 8/1937 | Kapprel | 105/9 |
| 2,224,562 | A | 12/1940 | Wolf | |
| 2,439,095 | A | 4/1948 | Mitchell | |
| 2,666,497 | A | 1/1954 | Weber | |
| 2,674,371 | A | 4/1954 | Blackinton | |
| 3,116,700 | A | 1/1964 | Aydelott | |
| 3,194,525 | A | 7/1965 | Webb | |
| 3,752,083 | A | 8/1973 | Bitterberg | |
| 3,771,293 | A | 11/1973 | Vest | |
| 3,789,747 | A | 2/1974 | Wasserman et al. | |
| 4,134,535 | A | 1/1979 | Barthels et al. | |
| 4,186,665 | A * | 2/1980 | de Jong et al. | 105/456 |
| 4,407,203 | A | 10/1983 | Harbin et al. | |
| 4,506,757 | A | 3/1985 | Matsumoto et al. | |
| 4,609,126 | A | 9/1986 | Janda | |
| 4,770,427 | A | 9/1988 | Howell et al. | |

(Continued)

FOREIGN PATENT DOCUMENTS

JP 2003254080 * 3/2002

OTHER PUBLICATIONS http://web.archive.org/web/20061114095417/http://www.power-technology.com/contractors/gensets/kirloskar/kirloskar1.html website published on Nov. 14, 2006.*

(Continued)

*Primary Examiner* — S. Jooseph Morano
*Assistant Examiner* — Zachary Kuhfuss
(74) *Attorney, Agent, or Firm* — Finnegan, Henderson, Farabow, Garrett & Dunner LLP

(57) ABSTRACT

A roof structure for a power module of a locomotive is disclosed. The roof structure may have an upper roof layer and at least a portion of the upper roof layer may have a first set of cooling passages. The roof structure may further have a lower roof layer at least partially positioned below the upper roof layer and at least a portion of the lower roof layer may have a second set of cooling passages. Each of the cooling passages of the first set of cooling passages may not overlap a cooling passage of second set of cooling passages.

19 Claims, 6 Drawing Sheets

U.S. PATENT DOCUMENTS

| | | | | |
|---|---|---|---|---|
| 5,731,687 | A * | 3/1998 | Hirano et al. | 322/1 |
| 5,765,329 | A | 6/1998 | Huang | |
| 5,950,753 | A | 9/1999 | Muldoon et al. | |
| 6,397,965 | B1 | 6/2002 | McFarlane et al. | |
| 6,575,102 | B2 * | 6/2003 | Norton et al. | 105/423 |
| 7,392,749 | B2 | 7/2008 | Bendig et al. | |
| 2004/0149159 | A1 | 8/2004 | Foesel et al. | |
| 2007/0134104 | A1 * | 6/2007 | Husted | 417/360 |

OTHER PUBLICATIONS

Union Pacific Acquiring 60 New Generation Environmentally Friendly Locomotives for Los Angeles Basin Rail Yards, *News Releases*, Feb. 9, 2006.

Multi-Engine GenSet Ultra Low Emissions Road-Switcher Locomotive, National Railway Equipment Co., printed from the Internet on Sep. 9, 2008, pp. 1-22.

U.S. EPA Region 5 "Tools & Incentives for Green Diesel Technology," Railroad Industry Overview, Sep. 6, 2006, pp. 1-23.

Ultra-Low Emissions "Genset" Switchers, CARB hearing, Jul. 13, 2006, pp. 1-15.

Sequential Diesel "Genset" Locomotive Rosters Railpower; NRE, MotivePower and other builders, J. Moore, Apr. 6, 2008, pp. 1-23.

Low Emissions Locomotive Spotter's Guide, J. Moore, Jun. 8, 2007, pp. 1-27.

Multi Gensets Locomotives for Canadian Railways, Railpower, May 2007, pp. 1-34.

Low-Emissions Multiple Engine, Genset Locomotive Rosters, Timbertimes, printed from the Internet on Sep. 9, 2008, pp. 1-10.

"Railroad Perspective on Locomotive Exhaust Aftertreatment & Technology—From idea to market: technology successes & limitations," Iden, Nov. 28, 2007, pp. 1-11.

"The N-viroMotive Product Line: Multi-Engine GenSet Ultra Low Emissions Road-Switcher Locomotives," National Railway Equipment Co., printed from the Internet on Sep. 9, 2008, pp. 1-17.

* cited by examiner

ROOF STRUCTURE FOR A LOCOMOTIVE POWER MODULE

TECHNICAL FIELD

The present disclosure relates generally to a power module for a locomotive and, more particularly, to a roof structure for the power module.

BACKGROUND

Mobile machines are known to include a power system for generating power. For example, a power system may include one or more electric motors, a generator unit, and a power-transfer system for transferring power from the generator unit to the one or more electric motors. It is known for the generator unit to include an engine for driving a generator. Often, the generator unit is housed within an enclosure to protect the generator unit from environmental elements. The enclosure is likely to trap a large amount of heat created by the generator unit, which may be dissipated via one or more cooling devices to maintain the generator unit operating conditions at an acceptable level. For example, it is known for a generator unit to include a radiator, a cooling fan, and/or other cooling devices for dissipating the heat within the enclosure.

In a generator unit mounted on a locomotive, it is known to house the generator unit within an enclosure and to cool the generator unit with one or more cooling devices. For example, it is known to employ a cooling passage located in walls of the enclosure. It is also known to circulate cooling air over the generator unit with a cooling fan.

Under some circumstances, locomotive power systems may discharge cooling air out of a top portion of the enclosure. For example, a portion of the power system enclosure may be covered with a wire mesh-type material. While the wire mesh-type material may allow cooling air to escape the enclosure and prevent large debris from entering the power system enclosure of the locomotive, environmental elements, such as precipitation (e.g., rain, snow, ice) and other debris, may penetrate the wire mesh-type material and contact the generator unit, thereby causing damage or otherwise reducing the life and efficiency of the generator unit.

One example of a roof structure providing ventilation is described in U.S. Pat. No. 4,609,126 to Janda ("the '126 patent"). The '126 patent discloses a venting cap for an enclosure used in an outdoor environment. The venting cap includes an inner roof panel and an outer roof panel. The outer roof panel includes a single outer aperture that is centrally positioned and offset from a plurality of inner apertures formed on the inner roof panel. Since the outer aperture is offset from the inner apertures, the venting cap may reduce the likelihood of precipitation passing through inner apertures into the apparatus housing. Further, an interior of the enclosure may be ventilated with cool air entering from an opening in the bottom of the enclosure and hot air may be vented through the outer aperture.

Although the venting cap of the '126 patent may alleviate some of the problems associated with cooling an enclosure, other problems may persist. The venting cap of '126 may not provide sufficient ventilation to remove heat generated by a power system, such as a locomotive power module. Additionally, the venting cap of the '126 patent may not be well suited for permitting operators to service the equipment housed within the enclosure by, for example, walking on the outer roof panel.

SUMMARY

In one aspect, the present disclosure is directed to a roof structure for a power module of a locomotive. The roof structure may include an upper roof layer and at least a portion of the upper roof layer may include a first set of cooling passages. The roof structure may further include a lower roof layer at least partially positioned below the upper roof layer and at least a portion of the lower roof layer may include a second set of cooling passages. Each of the cooling passages of the first set of cooling passages may not overlap a cooling passage of second set of cooling passages.

In another aspect, the present disclosure is directed to a method of cooling a power module for a locomotive. The method may include allowing a flow of cooling air to pass through at least a portion of at least one of the plurality of walls. The method may further include directing the flow of cooling air over at least a portion of the power module. The method may also include expelling the flow of cooling air through the roof structure, such that the flow of cooling air passes through a lower roof layer via a first set of cooling passages and through an upper roof layer via a second set of cooling passages. The method may additionally include collecting a majority of environmental elements that pass through the second set of cooling passages, such that the majority of environmental elements may be prevented from passing through the roof structure into the power module.

DETAILED DESCRIPTION

Figure 1:
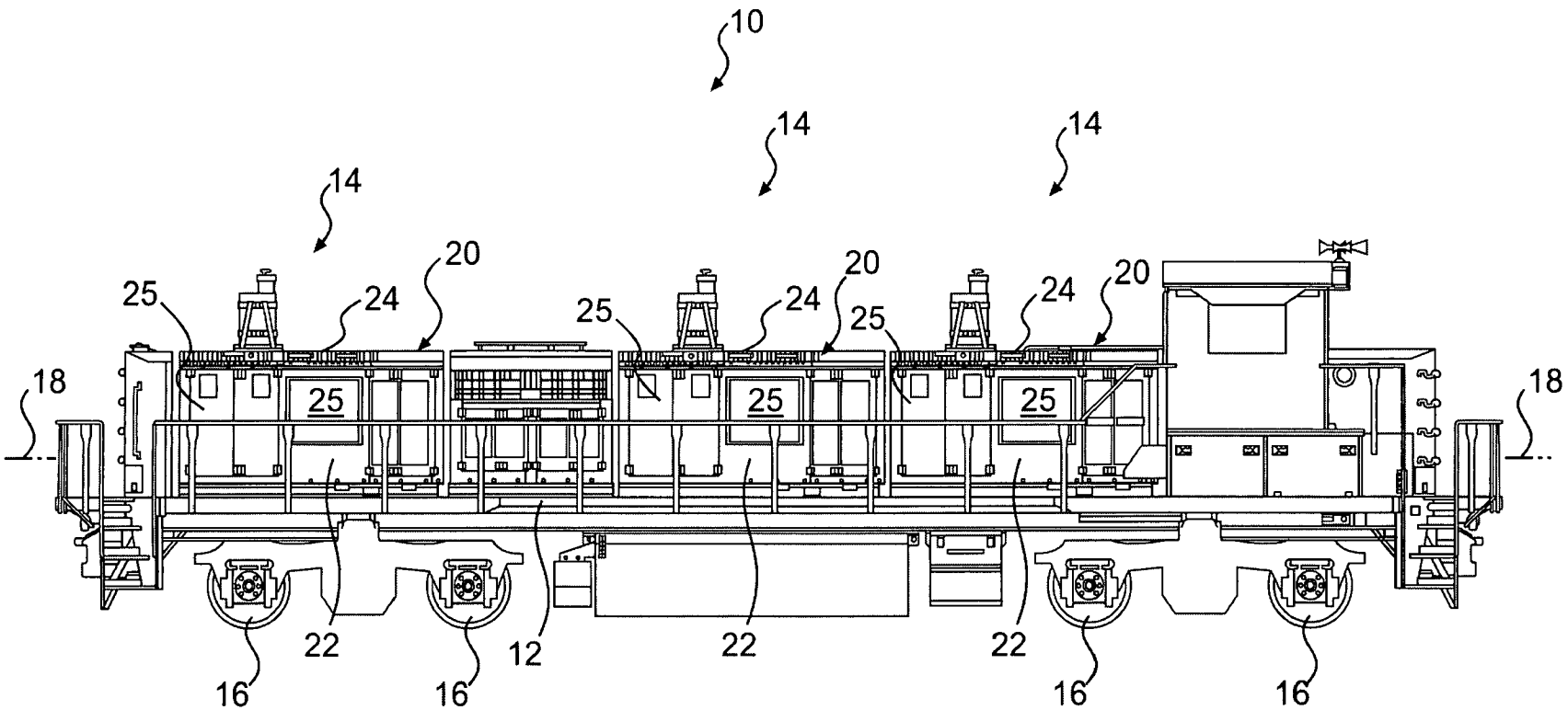
FIG. 1 is a side view of an exemplary locomotive including a plurality of power modules mounted thereon, in accordance with the present disclosure.

FIG. 1 illustrates a locomotive 10 including a platform 12 for supporting one or more power modules 14. Any number of power modules 14 sufficient to power locomotive 10 may be utilized. Each power module 14 may generate power that may be transferred, for example, to one or more traction motors (not shown) to drive traction devices 16. In an exemplary embodiment shown in FIG. 1, locomotive 10 may include three power modules 14 aligned on platform 12 along a longitudinal axis 18 that extends substantially in the direction of travel of locomotive 10. Each power module 14 may be at least partially enclosed within an enclosure 20. It is contemplated that enclosure 20 may include one or more walls 22 and a roof structure 24. In an exemplary embodiment, the enclosure may include four walls 22. In other words, enclosure 20 may surround four sides and the top of power module 14. Further, one or more walls 22 may include one or more wall access passages 25 for permitting an operator access into enclosure 20 and/or for permitting an intake of air into enclosure 20. It is contemplated that wall access passages 25 may include various types of covers including, for example, movable solid surfaces (e.g., hinged panel doors) for providing operator access and/or perforated surfaces (e.g., mesh screens and louvers) for permitting passage of air flow.

Figure 2:
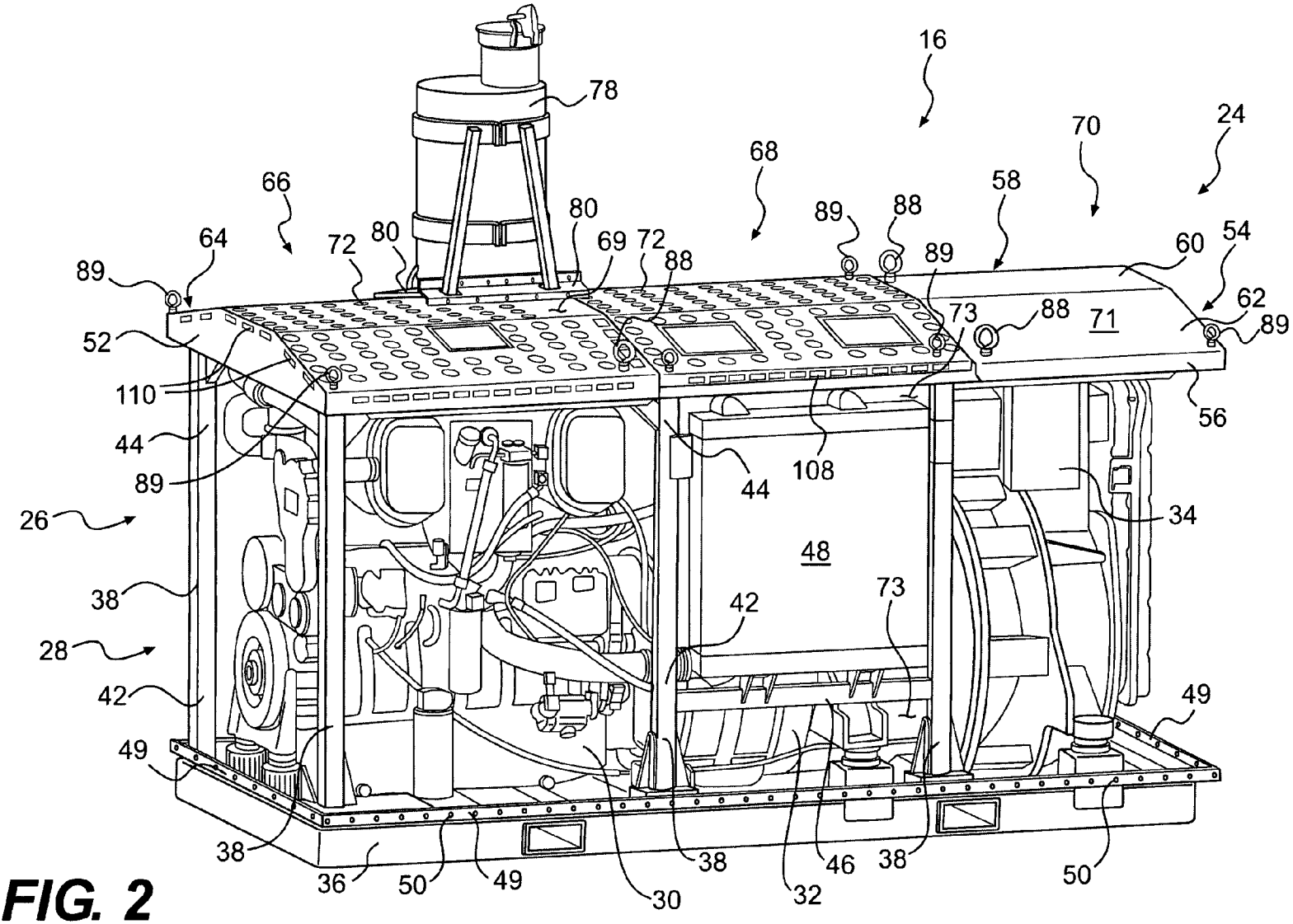
FIG. 2 is a diagrammatic illustration of a power module of the locomotive of FIG. 1 including a roof structure.

As shown in FIG. 2 with walls 22 of enclosure 20 removed, power module 14 may include a frame 26 that may provide structural rigidity for supporting at least a portion of a power system of the locomotive 10 including, for example, a generator set 28. For example, generator set 28 may include an engine 30 configured to drive a generator 32. Further, generator set 28 may include one or more auxiliary components 34 (e.g., a radiator, a rectifier, and cooling fans).

Figure 5:
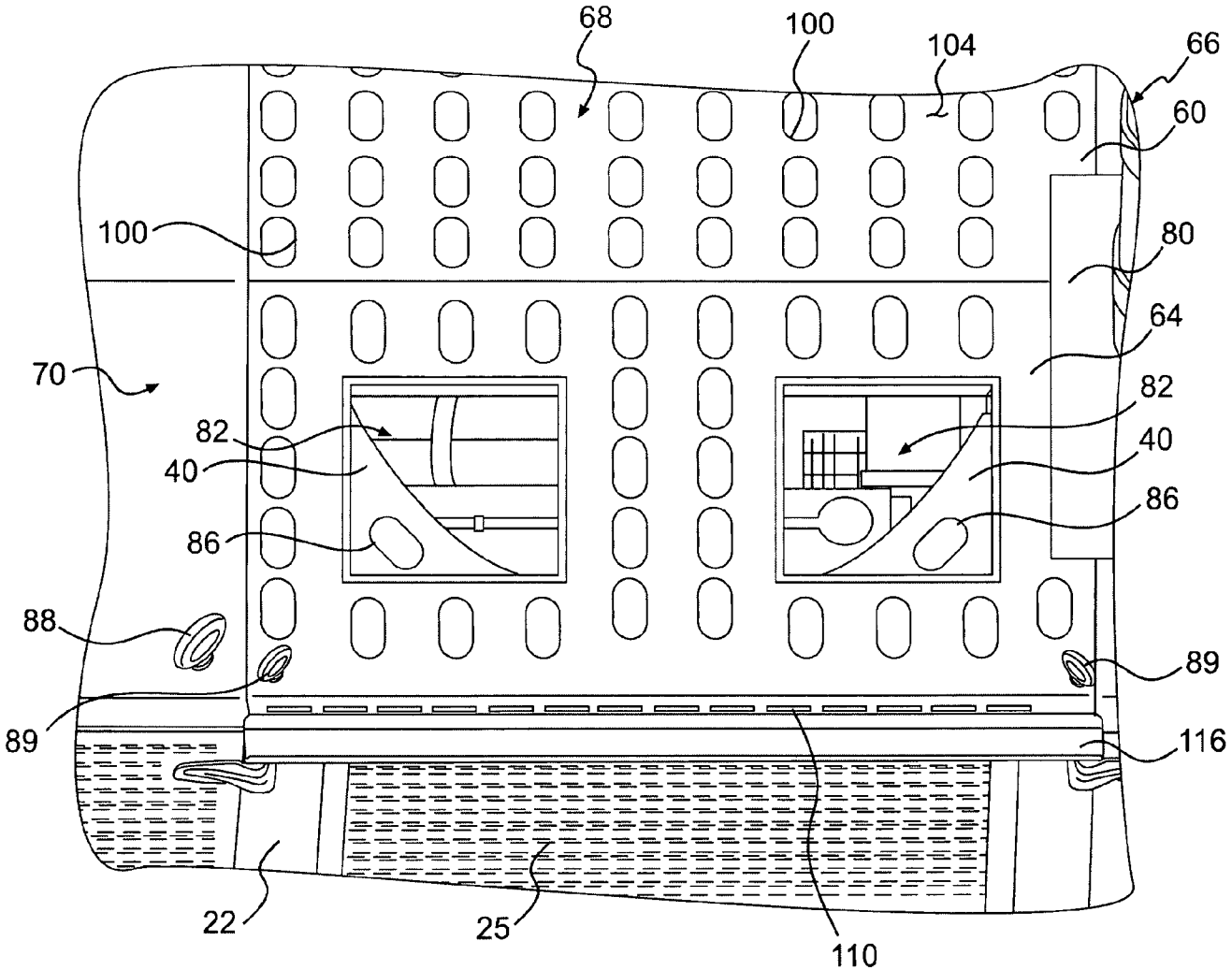
FIG. 5 is a diagrammatic illustration of exemplary frame access passages within the roof structure of FIG. 2 for accessing frame lifting eyes.

Frame 26 may include various structural elements including a base structure 36, vertical supports 38, and a top structure 40 (shown in FIG. 5). For example, base structure 36 may be attached to a lower end 42 of vertical supports 38, and top structure 40 may be attached a top end 44 of vertical supports 38. It is contemplated that frame 26 may include additional elements for adding structural rigidity or otherwise supporting one or more components of generator set 28. For example, frame 26 may include a cross brace 46 for supporting an aftercooler 48.

Power module 14 may be removably fastened to platform 12 via one or more fasteners (not shown). That is, frame 26 may fasten to platform 12 with any number or configuration of fasteners sufficient to securely fasten power module 14 to platform 12. In an exemplary embodiment, base structure 36 of frame 26 may fasten to platform 12 at four mounting locations (not shown), with each mounting location including a pair of fastening bolts (not shown).

Enclosure 20 may be removably fastened to frame 26, for example, along fastening rail 49 via walls 22 (not shown). It is contemplated that fastening rail 49 may be mounted on base structure 36 and include a plurality of holes 50 for receiving fasteners (not shown) to secure one or more of walls 22 of enclosure 20 to frame 26. Roof structure 24 may attach to one or more walls 22 (FIG. 1) and cover top structure 40 of frame 26 (best shown in FIG. 2).

Roof structure 24 may include a first end 52 spaced from and opposite to a second end 54. Roof structure 24 may also include a first side 56 spaced from and opposite to a second side 58. Roof structure 24 may include a substantially horizontal portion 60 that extends from first end 52 to second end 54, and positioned substantially midway between first side 56 and second side 58. Roof structure 24 may also include a first angled portion 62 extending from horizontal portion 60 to first side 56 and a second angled portion 64 extending from horizontal portion 60 to second side 58.

Roof structure 24 may also include a plurality of removable roof sections. For example roof structure 24 may include a first end roof section 66, a central roof section 68, and second end roof section 70, wherein each of roof sections 66, 68, 70 may be separately removable from enclosure 20 to provide access to power module 14. Roof sections 66, 68, 70 may individually fasten to walls 22 of enclosure 20 and/or frame 26 by one or more fasteners (not shown). First end roof section 66 may substantially cover first end 52 of power module 14. Central roof section 68 may substantially cover a central portion of power module 14. Second end roof section 70 may substantially cover second end 54 of power module 14. As shown in FIG. 2, central roof portion 68 may be removably fastened between each of first end roof section 66 and second end roof section 70.

One or more of roof sections 66, 68, 70 may include a plurality of cooling pathways 72. It is contemplated that cooling pathways 72 may help move heat generated by generator set 28 away from power module 14. For example, first end roof section 66 and central roof section 68 may each include a plurality of cooling pathways 72 substantially evenly spaced thereon and passing therethrough. Air passing through a cooling pathway 72 is shown, for example, in FIG. 6 and represented by arrow 118. However, it is also contemplated one or more sections of roof sections 66, 68, 70 may include a non-perforated section 69 to better protect generator set 28 from environmental elements (e.g., precipitation and debris).

In some situations, it may not be desirable to include cooling pathways 72 in one or more roof sections 66, 68, 70. For example, second end roof section 70 may include a solid surface 71. That is, second end roof section 70 and, more particularly, solid surface 71, may not include cooling pathways 72. Second end roof section 70 may not include cooling pathways 72 because excessive heat may not be generated in the space below second end roof section 70 and/or one or more components (e.g., rectifier) positioned in the space beneath second end roof section 70 may be sensitive and require greater protection from environmental elements than other components (e.g., engine 30) of generator set 28. While second end roof section 70 is shown with solid surface 71, it is contemplated than any one of roof sections 66, 68, 70 may include a solid surface. Further, it is contemplated that solid surface 71 may be implemented to cover roof sections with cooling pathways 72, for example, during abnormal environmental conditions (e.g., heavy precipitation). For example, one or more solid surfaces 71 may slide from a first roof section (e.g., second end roof section 70) to cover first end roof section 66 and second end roof section. Alternatively, solid section 71 may be moveable to change the section of roof structure 24 that includes uncovered cooling pathways 72.

A barrier wall 73 (identified in FIG. 2) may be located within frame 26. For example, such a barrier wall may be located along an area where two roof sections 66, 68, 70 join to block the flow of air through power module 14. For example, barrier wall 73 may protect the area under roof section 70 by blocking passage of heat generated by generator set 28 beneath first end roof section 66 and central roof section 68 through the space below second end roof section 70.

Figure 3:
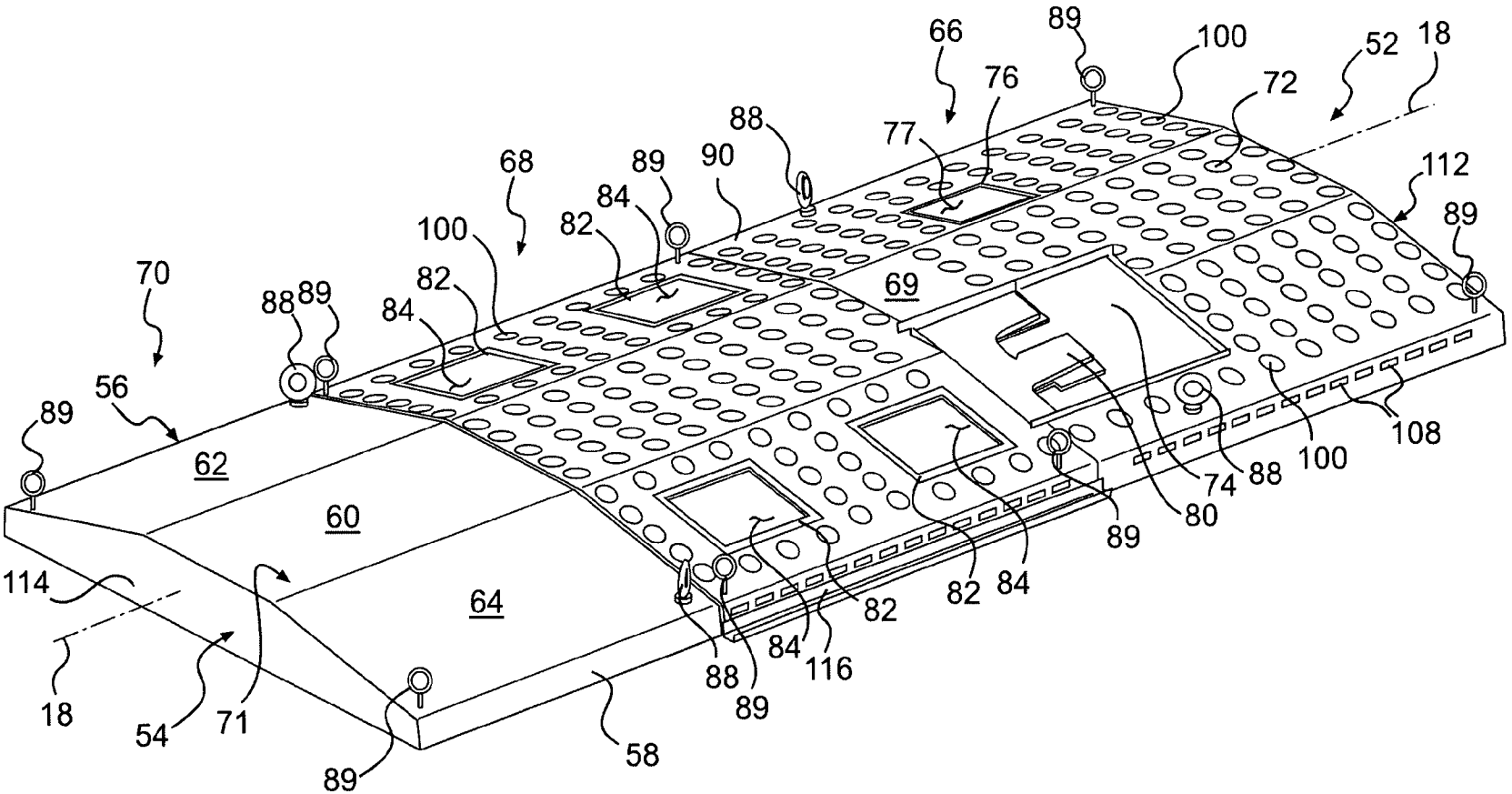
FIG. 3 is an isometric view of a top side of the roof structure of FIG. 2.

As previously noted, enclosure 20 may include one or more wall access passages 25. Enclosure 20 may also include one or more roof access passages to permit access to elements therein, such as for example, components of power module 14. For example, as shown in FIG. 3, first end roof section 66 may include an exhaust access passage 74 and a hydraulic reservoir vent access passage 76. Exhaust access passage 74 may permit an exhaust system including, for example, an exhaust stack 78 (see FIG. 2) to pass through roof structure 24. Exhaust access passage 74 may have a large cross-section with sufficient clearance to allow exhaust stack 78 to pass through roof structure 24. Roof structure 24 may include one or more removable exhaust shields 80 to block or otherwise limit the amount of precipitation or debris from penetrating exhaust access passage 74. In an exemplary embodiment, roof structure 24 may include three removable exhaust shields 80 to cover exhaust access passage 74 when elements of exhaust stack 78 extend through exhaust access passage 74. Exhaust shields 80 may be fastened to roof structure 24 via, for example, one or more fasteners (not shown). It is also contemplated that exhaust shields 80 may be pivotally attached to roof structure 24. While the exemplary embodiment discloses three exhaust shields 80 formed, for example, from bent sheet metal, any number, material, or configuration of exhaust shields 80 sufficient to block precipitation or debris passing through exhaust access passage 74 may be implemented. Hydraulic reservoir vent access passage 76 may provide access to a hydraulic reservoir vent (not shown) to allow an operator to service the vent. It is contemplated that hydraulic reservoir vent access passage 76 may be covered by a vent access door 77 that may be pivotally or otherwise attached to roof structure 24.

Figure 4:
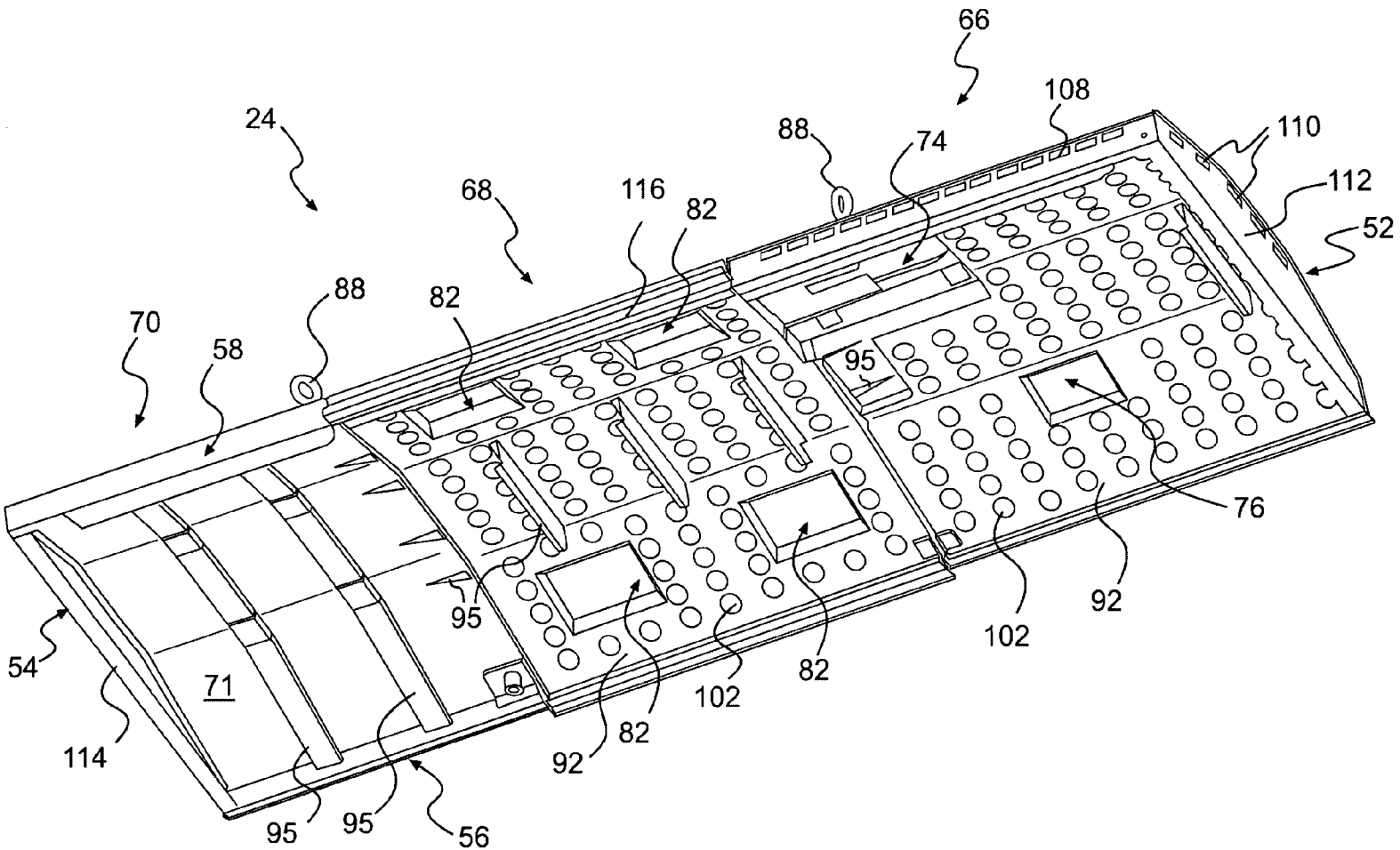
FIG. 4 is an isometric view of a bottom side of the roof structure of FIG. 2.

As shown in FIGS. 3 and 4, central roof section 68 may include a plurality of frame access passages 82, each covered, for example, by a corresponding frame access door 84 that may be pivotally or otherwise attached to roof structure 24. Frame access passages 82 may provide access within enclosure 20. In an exemplary embodiment, roof structure 24 may include four frame access passages 82 to provide access to top structure 40 of frame 26. As shown in FIG. 5, top structure 40 may include a plurality of frame lifting eyes 86, each accessible via a corresponding frame access passage 82. It is contemplated that a lifting machine, such as for example, a crane (not shown) may attach to the frame lifting eyes 86 to move power module 14.

As best shown in FIG. 3, roof structure 24 may include a plurality of sets of lifting eyes to permit removal of one or more portions of enclosure 20. For example, a plurality of enclosure lifting eyes 88 may be fastened to roof structure 24. In the exemplary embodiment shown in FIG. 3, roof structure 24 may include four enclosure lifting eyes 88 for lifting either roof structure 24 in its entirety (e.g., roof sections 66, 68, 70) or enclosure 20 in its entirety (e.g., roof structure 24 and four walls 22) from frame 26. It is also contemplated that each roof section 66, 68, 70 may include a set of roof section lifting eyes defined by one or more roof section lifting eyes 89 and/or one or more enclosure lifting eyes 88. For example, central roof section 68 may include four roof section lifting eyes 89. Alternatively, first end roof section 66 and second end roof section 70 may each include two roof section lifting eyes 89 and two enclosure lifting eyes 88. These lifting eyes may be provided in various configurations as necessary to provide a desired access to enclosure 20 and/or roof sections 66, 68, 70.

Figure 6:
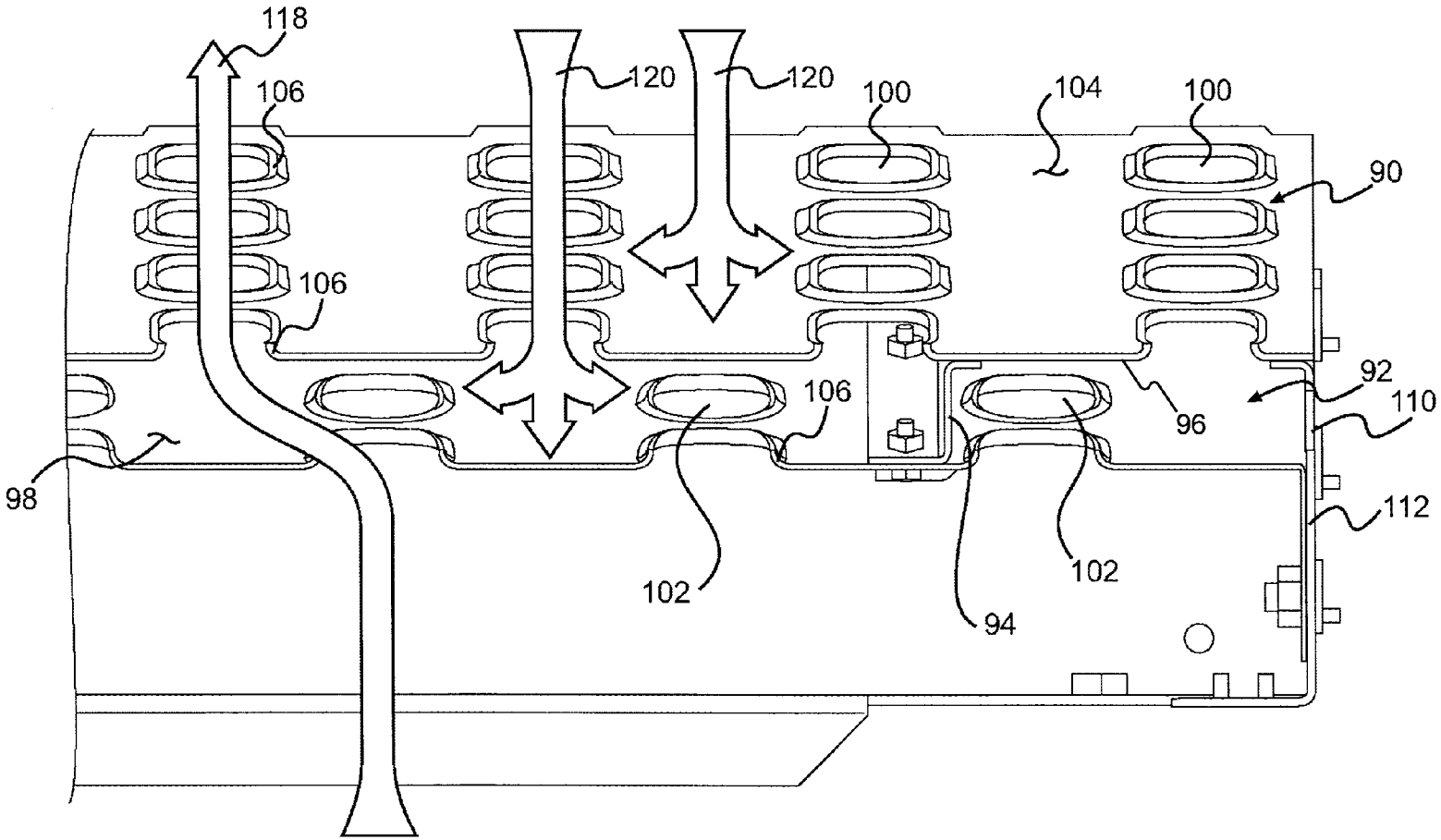
FIG. 6 is a partial cross-sectional view of the roof structure of FIG. 2.

As best shown in the cross-sectional view of FIG. 6, roof structure 24 may include a plurality of roof layers including, for example, an upper roof layer 90 and a lower roof layer 92. Upper roof layer 90 may be spaced from lower roof layer 92 by one or more interior supports. For example, a roof support 94 may extend between a bottom surface 96 of upper roof layer 90 and an upper roof surface 98 of lower roof layer 92. In an exemplary embodiment, each roof support 94 may be substantially S-shaped in cross section. As shown in FIG. 4, roof structure may also include additional roof supports 95, that may be any shape or configuration sufficient to support roof structure 24. For example, roof supports 95 may be triangular or U-shaped. Since second end roof section 70 may include solid surface 71, second end roof section 70 may not include a second roof layer as used roof sections having cooling pathways 72. Second end roof section 70 may include a single upper roof layer 90, as shown in FIG. 4. Alternatively, second end roof section 70 may include a single layer that is a thickness equal to the space between upper roof layer 90 and lower roof layer 92. Other suitable configurations will be apparent to those skilled in the art. Second end roof section 70 may include one or more second end roof section supports 95 to provide additional rigidity. Further, lower roof layer 92 may include one or more removed portions, for example to provide space for components of power module 14 within enclosure 20. For example, as shown in FIG. 4, first end roof section 66 may include a portion of lower roof layer 92 removed adjacent exhaust access passage 74 that is covered by non-perforated section 69 of upper roof layer 90.

Upper roof layer 90 may form a portion of the plurality of cooling pathways 72 including, for example, upper cooling passages 100. Likewise, lower roof layer 92 may form a portion of the plurality of cooling pathways 72 and may include, for example, lower cooling passages 102. Upper and lower cooling passages 100, 102 may be any shape or size sufficient to dissipate heat generated by generator set 28. For example, upper and lower cooling passages 100, 102 may substantially circular or oval in shape. Upper and lower cooling passages 100, 102 may be shaped similarly to one another or may differ from one another in shape and/or size. Upper and lower cooling passages 100, 102 may be oriented on roof structure 24 in any configuration that permits heat to escape from enclosure 20 and blocks or otherwise limits precipitation or debris from entering power module 14. In an exemplary embodiment, upper and lower cooling passages 100, 102 may each be configured in a grid-like orientation with upper and lower cooling passages 100, 102 arranged in columns and rows. Further, cooling passages 100, 102 may be substantially, evenly spaced over first end roof section 66 and central roof section 68. Alternatively, upper and lower roof layers 90, 92 may include cooling pathways defined as louvers (not shown).

It is contemplated that the alignment of upper cooling passages 100 relative to lower cooling passages 102 may be staggered or offset, for example, along a vertical direction (i.e., substantially perpendicular to horizontal portion 60). That is, upper cooling passages 100 may be offset from lower cooling passages 102 in a direction along longitudinal axis 18. Further, it is contemplated that the configuration of upper cooling passages 100 may be offset from lower cooling passages 102 in a direction transverse to longitudinal axis 18. In other words, upper roof layer 90 may include an upper roof surface 104 that is positioned above each of lower cooling passages 102 to cover lower cooling passages 102. Further, lower roof layer 92 may include upper roof surface 98 that extends directly beneath each of upper cooling passages 100. Therefore, precipitation or debris that may penetrate upper roof layer 90 through upper cooling passages 100 may be collected on upper roof surface 98 of lower roof layer 92 without passing through lower roof layer 92.

Each of the roof sections 66, 68, 70 that contain cooling pathways 72 may include cooling pathways 72 with different sizes, shapes, and/or configurations as compared to another one of roof sections 66, 68, 70. Although, first end roof section 66 and central roof section 68 are shown to have substantially the same configuration of upper and lower cooling passages 100, 102, it is contemplated that the size, shape, and/or configuration of upper and lower cooling passages 100, 102 may differ based on, for example, balancing the cooling needs and the environmental protection needs of each component (e.g., engine 30 and generator 32) of generator set 28.

As shown in FIG. 6, each of cooling passages 100, 102 may include a raised lip 106 to direct precipitation or debris to pool on upper roof surfaces 98, 104. Raised lips 106 may include a curved portion to help direct environmental elements (e.g., especially a liquid portion) away from cooling passages 100, 102 For example, each raised lip 106 may completely surround each of cooling passages 100, 102 to help block precipitation or debris collected on upper roof surfaces 98, 104 from passing through cooling passages 100, 102. Raised lips 106, especially on upper roof layer 90, may also serve to increase traction for an operator moving on top of roof structure 24 in order to service power module 14.

Upper roof layer 90 and lower roof layer 92 may include similar cross sections, wherein each roof layer 90, 92 may include horizontal portion 60 extending between first and second angled portions 62, 64. Therefore, the distance between upper roof layer 90 and lower roof layer 92 may remain substantially constant throughout the space defined between roof layers 90, 92. Further, precipitation or debris collected on upper roof surfaces 98, 104, may be guided from roof structure 24 via downward slope surfaces of upper and lower roof layers 90, 92 (e.g., first and second angled portions 62, 64). The liquid portion of the environmental elements that may penetrate upper cooling passages 100 and collect on upper roof surface 98 may be guided by first and second angled portions 62, 64 towards a first set of drain passages 108 adjacent each of first and second sides 56, 58, such that precipitation or debris may be drained from the space defined between upper roof layer 90 and lower roof layer 92.

Roof structure 24 may include a second set of drain passages 110 positioned along a first end wall 112 on first end 52 of roof structure 24. Drain passages 110 on first end wall 112 may be positioned along a roofline formed by lower roof layer 92, such that precipitation or debris, especially the liquid portion, collected on upper roof surface 98 may drain from the space defined between upper roof layer 90 and lower roof layer 92. Roof structure 24 may also include a second end wall 114 on second end 54. Since second end roof section 70 may not include cooling pathways 72, second end wall 114 may not include drain passages 110. However, in some situations, such as when second end roof section 70 includes cooling pathways 72, second end wall 114 may include drain passages 110. In addition to permitting draining of precipitation or debris, drain passages 108, 110 may also serve as additional cooling pathways 72, similar to cooling passages 100, 102, for permitting heat from generator set 28 to be expelled from power module 14.

As best shown in FIG. 5, roof structure 24 may include one or more gutters 116 located above one or more of wall access passages 25. Since wall access passages 25 may pull air into power module 14, wall access passages 25 may be vulnerable to penetration of precipitation or debris drained from roof structure 24. Therefore, gutters 116 may serve to direct precipitation or debris away from wall access passages 25.

Industrial Applicability

The enclosure of the power module may be applicable to any power system that may be subjected to environmental elements. The disclosed enclosure for housing the power module may include a roof structure that permits dissipation of heat and blocks or otherwise limits precipitation or debris from penetrating into the power module. The operation of roof structure 24 of enclosure 20 will now be described.

Roof structure 24 may include a multilayer configuration including cooling pathways 72 to facilitate dissipation of heat generated by power module 14. In addition to allowing heat to escape enclosure 20, cooling pathways 72 may also provide ingress for cooler ambient air. For example, a flow of cooling air may enter enclosure 20 through one or more wall access passages 25. The flow of cooling air may be directed by one or more cooling devices (e.g., cooling fans) toward generator set 28 to dissipate heat from within enclosure 20. A majority of the cooling air received into enclosure 20 through one or more wall access passages 25 may be expelled from enclosure 20 through roof structure 24. Alternatively or additionally, ambient air may enter enclosure 20 through cooling pathways 72 in roof structure 24. Air entering enclosure 20 may exit via cooling pathways 72 of roof structure 24. Air may also exist via wall access passages 25, however, as most exiting air will be heated, it is likely that it will rise and exit enclosure 20 via cooling pathways 72 in roof structure 24. Thus, for example, cooling air may enter enclosure 20 of power module 14 through wall access passages 25, pass over generator set 28 (i.e., cooling generator set 28) and heat the air. The heated air may exit power module 14 through roof structure 24.

While cooling passages 100, 102 may provide an exit for air (see, e.g., arrow 118 representing air exiting enclosure 20 in FIG. 6), the alignment of the cooling passages 100, 102 may provide the interior of enclosure 20 with protection from environmental elements such as precipitation and debris. As shown in FIG. 6, the offset cooling passages 100, 102 in roof layers 90, 92 may permit the passage of air but limits the passage of precipitation and debris (see, e.g., arrow 120 representing precipitation and debris movement). Thus, for example, precipitation and debris that penetrates roof layer 90 via cooling passages 100 encounters upper roof surface 98 of lower roof layer 92, rather than passing through lower cooling passages 102. Fluid that collects on upper roof surface 98 of lower roof layer 92 may be directed away from lower cooling passages 102 by raised lips 106. In addition, the angle of lower roof layer 92 further serves to direct fluid toward drain passages 108, 110, through which fluid may exit roof structure 24 without passing through enclosure 20. It is contemplated that a majority of the environmental elements may be collected on lower roof layer 92 and may be prevented from passing through roof structure 24.

Roof structure 24 may also include various features for servicing power module 14. For example, an operator may access exhaust stack 78 via exhaust access passage 74 and access the hydraulic reservoir vent (not shown) via hydraulic reservoir vent access passage 76. Further, an operator may open frame access doors 84 to reveal frame lifting eyes 86 (FIG. 5). In the exemplary embodiment, a crane (not shown) may fasten to frame lifting eyes 86 in order to move power module 14, for example, when installing power module 14 on platform 12. Alternatively, an operator may utilize the crane to fasten to enclosure lifting eyes 88 in order to move roof structure 24 in its entirety (e.g., roof sections 66, 68, 70) or to move enclosure 20 in its entirety (e.g., roof structure 24 and walls 22). As a further alternative, an operator may simply desire to move one or more roof sections 66, 68, 70 of roof structure 24 using one or more of the three sets of roof section lift eyes. For example, an operator may need to service engine 30 and may only remove first end roof section 66 with the crane using two roof section lifting eyes 89 and two enclosure lifting eyes 88 fastened to first end roof section 66. Further, for a worker moving on roof structure 24, raised lips 106 of cooling passages 100 may provide increased traction.

The disclosed roof structure 24 may increase heat dissipation and limit environmental element penetration through roof structure 24 with the use of the multilayer roof design including offset cooling passages 100, 102. Further, roof structure 24 may increase the versatility of lifting and/or moving one or more portions of power module 14 via the plurality of sets of lifting eyes 86, 88, 89.

It will be apparent to those skilled in the art that various modifications and variations can be made to the disclosed power module without departing from the scope of the disclosure. Other embodiments of the power module will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A roof structure for a power module of a locomotive, the roof structure comprising:

an upper roof layer including a substantially flat lower surface, at least a portion of the upper roof layer including a first set of cooling passages;

a lower roof layer including a substantially flat lower surface and being at least partially positioned below the upper roof layer, at least a portion of the lower roof layer including at least one drain passage, and at least a portion of the lower roof layer including a second set of cooling passages, wherein each of the cooling passages of the first set of cooling passages does not overlap a cooling passage of the second set of cooling passages; and at least one gutter disposed along the lower roof layer, the at least one gutter configured to receive environmental elements flowing through the at least one drain passage;

wherein the cooling passages of the first set include a first cooling passage, a second cooling passage, and a third cooling passage, the first cooling passage being aligned with the second cooling passage along a first direction and aligned with the third cooling passage along a second direction that is generally orthogonal to the first direction, each of the first, second, and third cooling passages including a raised lip;

a first portion of the upper roof layer extends along an entire distance separating the raised lips of the first and second cooling passages;

a second portion of the upper roof layer extends along an entire distance separating the raised lips of the first and third cooling passages; and the first portion and the second portion of the upper roof layer are substantially flat and substantially coplanar.

2. The roof structure of claim 1, wherein each of the cooling passages of the first and second sets of cooling passages includes a raised lip.

3. The roof structure of claim 1, wherein the portions of the upper roof layer and the lower roof layer including cooling passages form a first roof section;

and further comprising a second roof section without cooling passages, wherein the first and second roof sections are removably connected.

4. The roof structure of claim 3, further comprising a third roof section including first and second sets of cooling passages.

5. The roof structure of claim 1, wherein the upper roof layer is spaced from the lower roof layer by a roof support.

6. The roof structure of claim 5, wherein the roof support is substantially S-shaped.

7. The roof structure of claim 1, wherein a third portion of the upper roof layer and the lower roof layer slope in a third direction toward a first side of the roof structure, and a fourth portion of the upper roof layer and the lower roof layer slope in a fourth direction toward a second side of the roof structure, wherein each of the third and fourth sloped portions extend between a first end of the roof structure and a second end of the roof structure.

8. The roof structure of claim 1, wherein at least one of the cooling passages of the second set includes a raised lip, and the raised lips of the upper and lower roof layers extend from the respective roof layer in the same direction.

9. The roof structure of claim 1, wherein the upper roof layer and the lower roof layer are substantially flat.

10. The roof structure of claim 1, wherein a third portion of the upper roof layer and the lower roof layer slope in a third direction toward a first side of the roof structure.

11. The roof structure of claim 10, wherein a fourth portion of the upper roof layer and the lower roof layer slope in a fourth direction toward a second side of the roof structure.

12. The roof structure of claim 1, wherein:

the cooling passages of the second set include a fourth cooling passage, a fifth cooling passage, and a sixth cooling passage, the fourth cooling passage being aligned with the fifth cooling passage along a fifth direction and aligned with the sixth cooling passage along a sixth direction that is generally orthogonal to the fifth direction, each of the fourth, fifth, and sixth cooling passages including a raised lip;

a first portion of the lower roof layer extends along an entire distance separating the raised lips of the fourth and fifth cooling passages;

a second portion of the lower roof layer extends along an entire distance separating the raised lips of the fourth and sixth cooling passages; and the first portion and the second portion of the lower roof layer are substantially flat and substantially coplanar.

13. A method of cooling a power module for a locomotive, the power module having a plurality of walls and a roof structure, the method comprising:

allowing a flow of cooling air to pass through at least a portion of at least one of the plurality of walls;

directing the flow of cooling air over at least a portion of the power module;

expelling the flow of cooling air through the roof structure, such that the flow of cooling air passes through a lower roof layer via a first set of cooling passages and through an upper roof layer via a second set of cooling passages;

collecting a majority of environmental elements that pass through the second set of cooling passages, such that the majority of environmental elements are prevented from passing through the roof structure into the power module; and draining a liquid portion of the environmental elements collected on the lower roof layer through one or more drain passages and into gutters along a side of the roof structure.

14. The method of claim 13, further comprising directing the environmental elements that pass through the second set of cooling passages away from the first set of cooling passages with raised lips that surround each of the first set of cooling passages.

15. A power module for a locomotive, the power module comprising:

a frame;

a generator set supported by the frame;

an enclosure covering the frame and including a plurality of walls and a roof structure, the roof structure comprising:

a first roof section including a plurality of cooling passages configured to expel heat generated by the power system through the first roof section and limiting environmental elements from entering the power module through the first roof section, the first roof section including an upper roof layer and a lower roof layer, the plurality of cooling passages including a first set of cooling passages in the upper roof layer and a second set of cooling passages in the lower roof layer, each of the cooling passages in the first set of cooling passages being positioned over an upper roof surface of the lower roof layer, wherein a first portion of the upper roof layer and the lower roof layer slopes in a first direction toward a first side of the roof structure; and a second roof section removeably positioned adjacent the first roof section and including a solid surface.

16. The power module of claim 15, wherein one or more of the walls includes a wall access passage configured to pass a flow of cooling air into the enclosure, and further including a cooling device to direct the flow of cooling air over the generator set and out of the enclosure through the roof structure.

17. The power module of claim 15, wherein a second portion of the upper roof layer and the lower roof layer slope in a second direction toward a second side of the roof structure.

18. The power module of claim 15, wherein the upper roof layer and the lower roof layer are substantially flat.

19. The power module of claim 15, wherein at least one of the cooling passages of the first set includes a raised lip, and at least one of the cooling passages of the second set includes a raised lip, wherein the raised lips of the upper and lower roof layers extend from the respective roof layer in the same direction.

* * * * *